US010060204B2

(12) United States Patent
Manson

(10) Patent No.: US 10,060,204 B2
(45) Date of Patent: Aug. 28, 2018

(54) FLUSHING TOOL AND METHOD OF FLUSHING PERFORATED TUBING

(75) Inventor: David J. Manson, South Lake, WA (US)

(73) Assignee: PEAK WELL SYSTEMS PTY LTD, Bayswater (AU)

( * ) Notice: Subject to any disclaimer, the term of this patent is extended or adjusted under 35 U.S.C. 154(b) by 410 days.

(21) Appl. No.: 14/127,625

(22) PCT Filed: Jun. 21, 2012

(86) PCT No.: PCT/AU2012/000718
§ 371 (c)(1),
(2), (4) Date: Mar. 4, 2014

(87) PCT Pub. No.: WO2012/174600
PCT Pub. Date: Dec. 27, 2012

(65) Prior Publication Data

US 2014/0182699 A1 Jul. 3, 2014

(30) Foreign Application Priority Data

Jun. 21, 2011 (AU) ..... 2011902417

(51) Int. Cl.

| | |
|---|---|
| ***E21B 21/00*** | (2006.01) |
| ***E21B 34/14*** | (2006.01) |
| ***E21B 37/08*** | (2006.01) |
| ***E21B 43/14*** | (2006.01) |
| *E21B 34/00* | (2006.01) |

(52) U.S. Cl.
CPC ..... *E21B 21/00* (2013.01); *E21B 34/14* (2013.01); *E21B 37/08* (2013.01); *E21B 43/14* (2013.01); *E21B 2034/007* (2013.01); *Y10T 137/0424* (2015.04); *Y10T 137/4245* (2015.04)

(58) Field of Classification Search
CPC ..... E21B 37/08
See application file for complete search history.

(56) References Cited

U.S. PATENT DOCUMENTS 3,089,544 A * 5/1963 Cobb ..... E21B 37/08 166/162
3,712,378 A 1/1973 Olivier
(Continued)

OTHER PUBLICATIONS

International Search Report Issued in PCT/AU2012/000718 dated Sep. 12, 2012.
Written Opinion Issued in PCT/AU2012/000718 dated Sep. 12, 2012.

*Primary Examiner* — D. Andrews
(74) *Attorney, Agent, or Firm* — FisherBroyles, LLP

(57) ABSTRACT

A flushing tool for a perforated tubing in a production tubing string is described. The flushing tool includes a chamber that is sealed at a pressure at or below atmospheric pressure when the flushing tool is in its sealed configuration, the chamber arranged to receive wellbore fluids when the flushing tool is in its activated configuration. A port allows ingress of wellbore fluids into the chamber when the flushing tool is in its activated configuration. A sealing means has a first position when the flushing tool is in its sealed configuration and a second position when the flushing tool is in its activated configuration. An actuator releases the flushing tool from its sealed configuration to its activated configuration by releasing the sealing means to move from the first position to the second position.

27 Claims, 7 Drawing Sheets

(56) References Cited

U.S. PATENT DOCUMENTS

| | | | | |
|---|---|---|---|---|
| 4,393,930 | A | 7/1983 | Ross et al. | |
| 6,006,838 | A | 12/1999 | Whiteley et al. | |
| 7,322,417 | B2 * | 1/2008 | Rytlewski ..... | E21B 23/02 166/313 |
| 2004/0099418 | A1 | 5/2004 | Behrmann et al. | |

* cited by examiner

FLUSHING TOOL AND METHOD OF FLUSHING PERFORATED TUBING

This application is the U.S. national phase of International Application No. PCT/AU2012/000718 filed 21 Jun. 2012 which designated the U.S. and claims priority to AU Patent Application No. 2011902417 filed 21 Jun. 2011, the entire contents of each of which are hereby incorporated by reference.

FIELD OF THE INVENTION

The present invention pertains to hydrocarbon production, and more particularly, to improving the flow of hydrocarbons from an underperforming producing well. The present invention relates to a flushing tool and a method of flushing perforated tubing in any type of well, including sub-sea wells, platform wells and land wells.

BACKGROUND TO THE INVENTION

It is known to drill wells to extract oil or gas from hydrocarbon-bearing strata located underground or under the seabed. After an oil or gas well has been drilled and casing has been installed to establish a well bore, a string of production tubing is run into the well to direct the flow of hydrocarbons up the cased well bore and out of the well. One or more selected portions of the production tubing string is perforated adjacent to the location of known hydrocarbon-bearing strata to allow hydrocarbons to enter and flow upwardly through the production tubing string. Methods of perforating tubing are well known in the art. Such methods include the use of explosive charges or the firing of projectiles.

Over time, it is known for flow of hydrocarbons through the perforated tubing to become impeded when debris is deposited in the perforations or scaling occurs. As production flow drops off, an operator may suspect that scale or other debris is blocking perforations in the production tubing.

The present invention was developed to provide a flushing tool and a method of flushing perforated tubing to improve the flow of hydrocarbons from a producing well.

SUMMARY OF THE INVENTION

According to a first aspect of the present invention there is provided a flushing tool for a perforated tubing in a production tubing string containing wellbore fluids, the flushing tool having a sealed configuration and an activated configuration, the flushing tool comprising:

- a chamber that is sealed at a pressure at or below atmospheric pressure when the flushing tool is in its sealed configuration, the chamber arranged to receive wellbore fluids when the flushing tool is in its activated configuration;
- a port for allowing ingress of wellbore fluids into the chamber when the flushing tool is in its activated configuration;
- a sealing means having a first position when the flushing tool is in its sealed configuration in which the port is sealed against the ingress of wellbore fluids and a second position when the flushing tool is in its activated configuration in which the port is open to allow wellbore fluids flow to flow into the chamber; and,

- an actuator for releasing the flushing tool from its sealed configuration to its activated configuration by releasing the sealing means to move from the first position to the second position,
- whereby, in use, movement of the sealing means into the second position causes an ingress of wellbore fluids into the chamber whereby the perforated tubing is flushed to improve hydrocarbon flow.

In one form, the sealing means is self-opening upon activation of the actuator. In one form, the sealing means moves from the first position to the second position upon release under the influence of differential pressure applied by the wellbore fluids. In one form, the chamber is of variable length depending on the size of perforated tubing to be flushed. In one form, the sealing means is a sliding or rotating sleeve. In one form, the port is one of a plurality of ports. In one form, the pressure within the chamber is held at or below atmospheric pressure when the flushing tool is in its sealed configuration. In one form, the actuating means is activated by way of application of a jarring force. In one form, the actuating means is activated using a timer configured to release the sealing means after a pre-set interval of time. In one form, the actuating means comprises a set of locking keys receivable within a keyway provided in a key support sleeve. In one form, a set of actuating shear screws prevents axial movement of the key support sleeve whilst the flushing tool is in its sealed configuration until a sufficient force is applied to shear the actuating shear screws. In one form, the perforated tubing is located adjacent to at least one producing zone in a hydrocarbon formation. In one form, the at least one producing zone is one of a plurality of producing zones within a hydrocarbon-bearing formation.

In one form, the flushing tool is one of a plurality of flushing tools provided in a stacked arrangement to form a flushing assembly. In one form, the chamber of each of the plurality of flushing tools is independently sealed. In one form, a flushing tool in the flushing assembly straddles more than one of the plurality of producing zones. In one form, the chamber further comprises a shear out plug retained by a shear out plug release means, whereby in use, the ingress of wellbore fluids causing shearing of the shear out plug release means to allow downward movement of the shear out plug. In one form, the flushing tool includes a lower piston retained by a lower piston release means, whereby in use, downward movement of the shear out plug causing shearing of the lower piston release means to allow downward movement of the lower piston. In one form, the flushing tool includes an impact sub arranged at a lower end of the flushing tool, whereby in use, downward movement of the lower piston of an upper flushing tool bring the impact sub of the upper flushing tool into abutting contact with a lower or intermediate flushing tool in a flushing tool assembly with sufficient force to cause actuation of the lower or intermediate flushing tool.

According to a second aspect of the present invention there is provided a method of flushing a perforated tubing in a production tubing string containing wellbore fluids using a flushing tool having a sealed configuration and an activated configuration, the method comprising the steps of:

a) running the flushing tool in its sealed configuration into the production tubing string using a running tool, the flushing tool having a chamber sealed at a pressure at or below atmospheric pressure when the flushing tool is in its sealed configuration, b) landing the flushing tool in its sealed configuration adjacent to the perforated tubing;

c) thereafter releasing the flushing tool from its sealed configuration to its activated configuration whereby the perforated tubing is flushed as wellbore fluids flow into the chamber.

In one form, the flushing tool is one of a plurality of flushing tools and step a) and step b) are performed for each flushing tool to form a flushing tool assembly having an upper flushing tool and a lower flushing tool in a stacked arrangement. In one form, releasing the upper flushing tool from its sealed configuration to its activated configuration in step c) causes the lower flushing tool to be released from its sealed configuration to its activated configuration. In one form each of the plurality of flushing tools is run into the production tubing string in sequence using a suitable running tool. In one form, the method further comprises the step of soaking the perforated tubing prior to flushing using an anti-scaling or anti-fouling agent.

According to a third aspect of the present invention there is provided a flushing tool substantially as herein described with reference to and as illustrated in the accompanying figures.

According to a fourth aspect of the present invention there is provided a method of flushing a perforated tubing in a production tubing string containing wellbore fluids substantially as herein described with reference to and as illustrated in the accompanying figures.

BRIEF DESCRIPTION OF THE DRAWINGS

In order to facilitate a more comprehensive understanding of the nature of the invention, embodiments of the tools in accordance with the various aspects of the invention will now be described in detail, by way of example only, with reference to the accompanying drawings, in which.

DETAILED DESCRIPTION OF THE PREFERRED EMBODIMENTS OF THE PRESENT INVENTION

Before the preferred embodiments of the apparatus and method of the present invention are described, it is to be understood that the terminology used herein is for the purpose of describing particular embodiments only, and is not intended to limit the scope of the present invention. In the interest of clarity, the illustrations have been split into sections. The overall length of the flushing tool of the present invention can vary depending on such relevant factors as the depth of the producing zone. For this reason, the chamber described below is shown in the relevant figures as having a variable length. Unless defined otherwise, all technical and scientific terms used herein have the same meanings as commonly understood by one of ordinary skill in the art to which this invention belongs.

Figure 1:
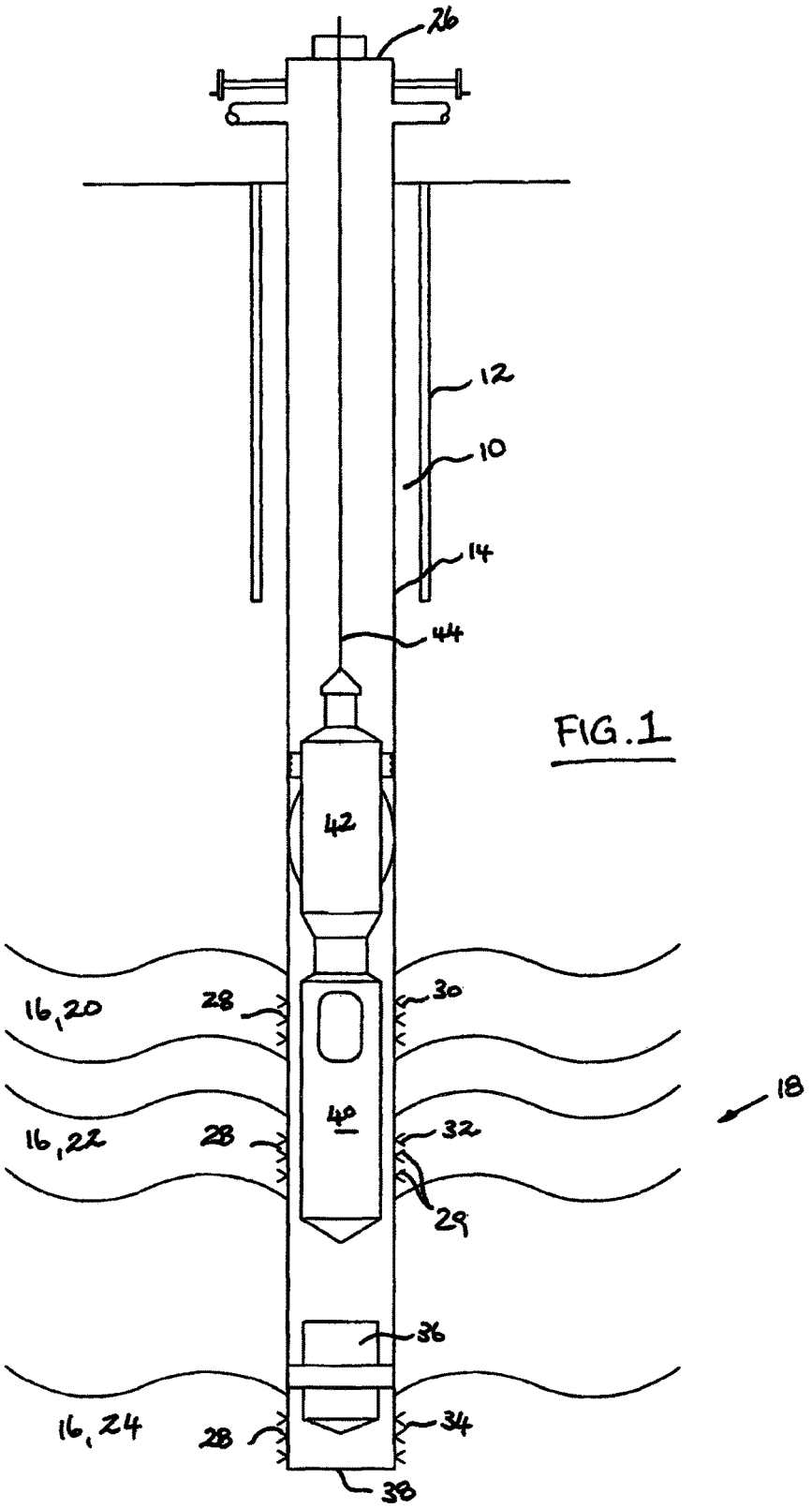
FIG. 1 is a vertical section view taken through a well showing the a flushing tool located at a producing zone in the well bore according to a first embodiment of the present invention.
Figure 2:
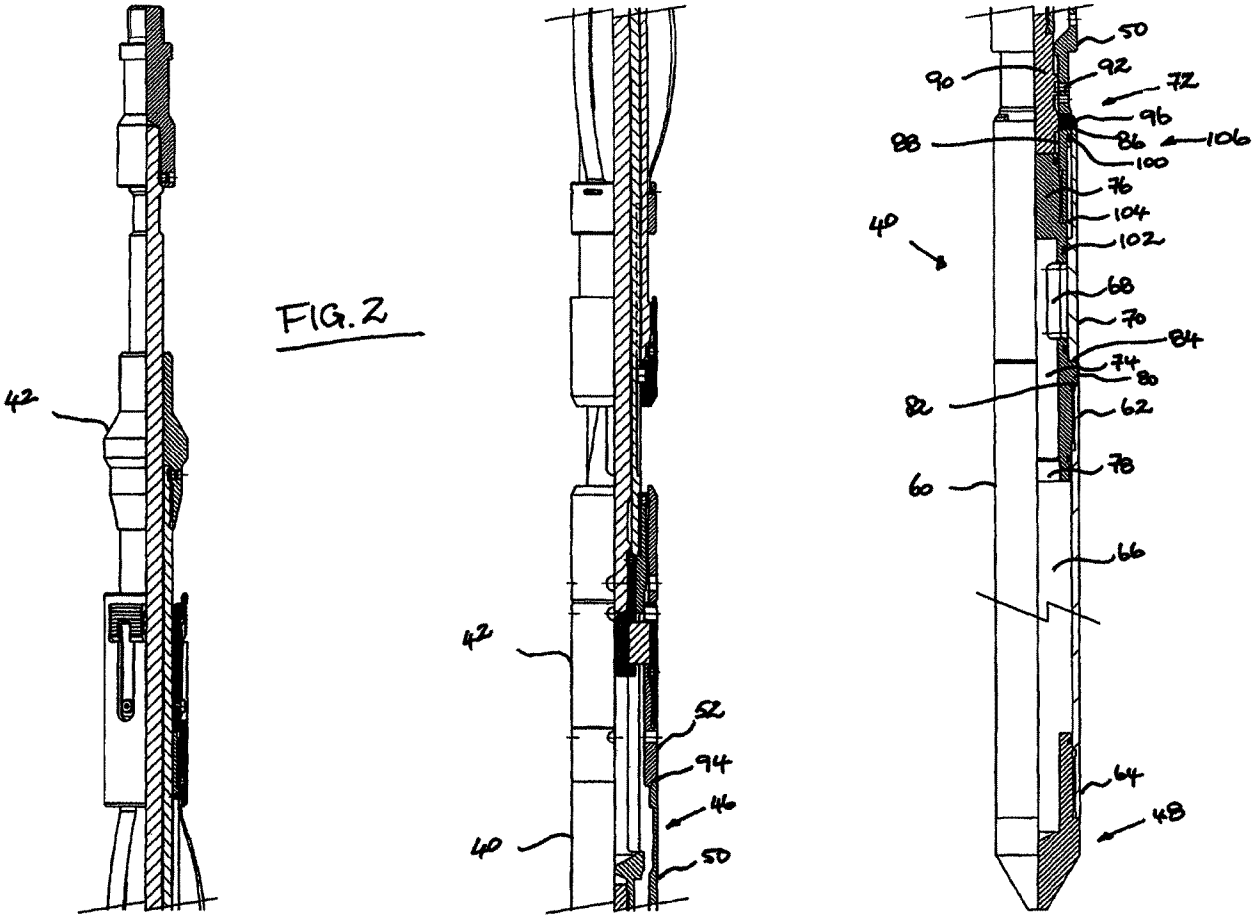
FIG. 2 is a partial cross-sectional view of a first embodiment of a flushing tool shown in a sealed configuration suitable for running into a well bore split into three portions for the interest of clarity.
Figure 3:
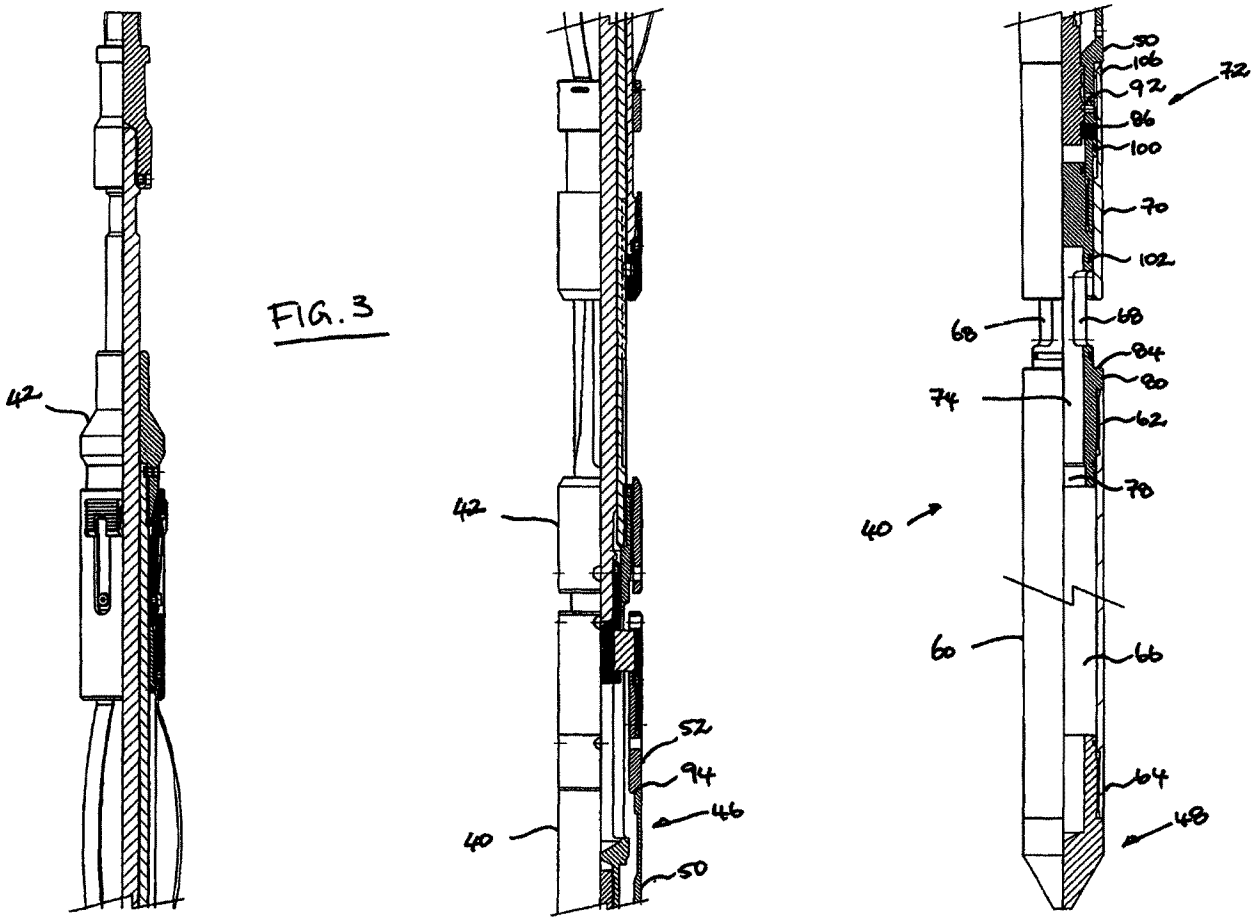
FIG. 3 is a partial cross-sectional view of a first embodiment of a flushing tool shown in an activated configuration suitable for running into a well bore split into three portions for the interest of clarity.

A first embodiment of the present invention is now described with particular reference to FIGS. 1 to 3 which rely on the use of a single flushing tool. A second embodiment of the present invention involving the use of a set of stackable flushing tools is then described with particular reference to FIGS. 4 to 7. In each of FIGS. 2, 3, 5, 6 and 7, the uppermost end of the flushing tool is shown towards the left-hand upper edge of each of the drawing sheets.

Referring to FIG. 1, a well 10 is illustrated with an optional outer well casing 12 and a production tubing string 14 installed therein. The production tubing string 14 passes through at least one producing zone 16 of a hydrocarbon-bearing formation 18. The at least one producing zone may be one of a plurality of producing zones within a hydrocarbon-bearing formation. By way of example only, in the embodiment illustrated in FIG. 1, three producing zones are shown at progressively increasing depths, namely an upper producing zone 20, an intermediate producing zone 22 and a lower producing zone 24. The intermediate producing zone may be one of a plurality of intermediate producing zones. The production tubing string 14 is supported by a well head 26 where it is connected to a production flow control device such as a Christmas tree (not shown) which is provided with a set of control valves that can be used to control the flow of hydrocarbons through the production tubing string 14.

In order to provide a path for hydrocarbons to flow out from the hydrocarbon-bearing formation 18 and into the production tubing string 14, at least one portion of the production tubing string 14 is perforated using techniques known in the drilling and completion arts at a location adjacent to the at least one producing zone 16. Throughout this specification, the term "perforation" is used to describe a hole that penetrates or passes through the wall thickness of the production tubing string 14 to bring the production tubing string 14 into fluid communication with a producing zone 16 of the hydrocarbon-bearing formation 18. The term "perforated tubing" and the reference numeral 28 is used to describe that portion of the production tubing string that has been perforated such that plurality of perforations facilitate hydrocarbon fluid flow through the perforated tubing 28. After perforation, the hydrocarbons that flow out of the at least one producing zone 16 flow upwards towards the well head 22 by passing through the perforated tubing 28 and into the production tubing sting 14.

As can be seen in FIG. 1, perforated tubing 28 is located adjacent to each of the three producing zones 16. More specifically, a first perforated tubing 30 is located adjacent to the upper producing zone 20, a second perforated tubing 32 is located adjacent to the intermediate producing zone 22, and a third perforated tubing 34 is located adjacent to the lower producing zone 24.

During hydrocarbon production from the well, the production tubing string 14 is filled with wellbore fluids which form a hydrostatic pressure head that assists in controlling the flow of hydrocarbons from the producing zone 16. Such wellbore fluids may include hydrocarbons, weighted brine, diesel and/or salt water. The pressure experienced by the wellbore fluids increases with depth such that the pressure is highest towards the lowermost end 38 of the production tubing string 14. The pressure experienced by the hydrocarbon fluids progressively decreases the higher the hydrocarbon fluids flow up the production tubing string. The consequence of this is that the velocity of hydrocarbon fluid flow through the production tubing string 14 is far greater at the well head 22 than it is through the perforations in the perforated tubing 28. Over time, the flow of hydrocarbons from at least one producing zone 16 may become diminished due to partial of complete blockage of one or more perforations 29 in the perforated tubing 28. The method and apparatus of the present invention has been designed to alleviate this problem to restore or improve production flow.

In the embodiment illustrated in FIG. 1, a temporary or permanent first isolation packer or plug 36 is run into the production tubing string 14 and set at a depth above the lower producing zone 24 but below the depth of the upper and intermediate producing zones (20 and 22, respectively). In this embodiment, the first isolation plug 36 forms a pressure seal that prevents the flow of hydrocarbons from the lower producing zone 24 from entering into the production tubing string 14. The first isolation plug 36 can be equally be run into the well and set at any desired location using techniques known in the art.

If, by way of example, a well operator wished to perform flushing operations on all of the perforated tubing, then the first isolation plug can be positioned below the depth of the lower producing zone 24. If the production tubing string 14 has already been provided with a cement plug at its lowermost end 38, then reliance may be placed of that cement plug to perform the function of the first isolation plug 36. If, by way of a further example, an operator wished to perform flushing operations on the first perforated tubing 30 only, then the first isolation plug 36 could be run into the production tubing string 14 and set at a depth above the intermediate producing zone 22 but below the depth of the upper producing zone 20. In this way, the first isolation plug 36 forms a pressure seal that prevents the flow of hydrocarbons from the intermediate and lower producing zones (22 and 24, respectively) from entering into the production tubing string 14.

Having isolated the at least one producing zone 16, a flushing tool 40 is run into the production tubing string 14 and landed at a selected depth adjacent to at least one producing zone 16 using a suitable running tool 42. The running tool 42 is run into the well on wireline, slickline, coiled tubing or any other means that is suitable for transferring an axial force applied to it to the running tool. An example of a suitable running tool is described in U.S. Patent Publication Number 2006/0272828, the contents of which are incorporated herein by reference.

In the embodiment illustrated in FIG. 1, the running tool 42 is suspended from wireline 44 which is used to manipulate the running tool 42 and flushing tool 40 as well as set them both in a desired position in the well bore 10. The wireline is also used to retrieve the running tool 42 and flushing tool 40 back to surface after use. The flushing tool 40 has an upper end 46 and a lower end 48. The upper end 46 of the flushing tool 40 terminates in an external or internal fishing neck 50 which is configured for engagement with the lower end 52 of the running tool 42. The lower end 48 of the flushing tool 40 may be configured for abutting contact with the first isolation plug 36 to assist in correctly positioning the flushing tool 40 in the production tubing string 14.

The flushing tool 40 has a sealed configuration as described in detail below with particular reference to FIG. 2 and an activated configuration as described in detail below with particular reference to FIG. 3. When a plurality of flushing tools are provided in a stacked arrangement, the flushing tool 40 also has a load transfer configuration as described in detail below with particular reference to FIG. 7.

In general terms, the flushing tool 40 is provided with a main body 60 having an upper end 62 and a lower end 64 defining a chamber 66 that is sealed at a pressure at or below atmospheric pressure when the flushing tool is in its sealed configuration. The chamber 66 is arranged to receive wellbore fluids when the flushing tool is in its activated configuration as described in greater detail below. The flushing tool 40 has a port 68 for allowing access of wellbore fluids into the chamber 66 when the flushing tool 40 is in its activated configuration. The port 68 may be one of a plurality of ports as described in greater detail below. The flushing tool 40 is further provided with a sealing means 70 having a first position (as illustrated in FIG. 2 for the first embodiment of the present invention) when the flushing tool is in its sealed configuration and a second position (as illustrated in FIG. 3 for the first embodiment of the present invention) when the flushing tool is in its activated configuration. When the sealing means 70 is in its first position, the port 68 is closed so as to seal the chamber 66 against the ingress of wellbore fluids. When the sealing means is in its second position, the port 68 is open to allow wellbore fluids flow to flow into the chamber 66. An actuating means 72 is provided to allow the sealing means to move from the first position to the second position under the influence of the differential pressure between the chamber and the wellbore fluids.

In its most basic form, the pressure within the chamber 66 is held at atmospheric pressure when the flushing tool is in its sealed configuration. If desired, a vacuum can be applied to reduce the pressure within the sealed chamber 66 below atmospheric pressure. By way of example only, at a depth of 10,000 feet, the hydrostatic pressure experienced by the wellbore fluids present in the well bore at that depth is in the order of 5,000 psi. Thus, the pressure within the chamber of the flushing is far lower than that of the surrounding wellbore fluids. When the actuating means is actuated, the sealing means 70 is released to move from its first position to its second position under the influence of the pressure differential between the pressure in the sealed chamber and the pressure of the wellbore fluids. Wellbore fluids are suddenly drawn into the chamber 66 through the port 68. The surge of wellbore fluid into the flushing tool causes a corresponding surge of hydrocarbons through the perforations of the perforated tubing 28 and into the production tubing 14. This sudden surge of hydrocarbons through the perforated tubing results in flushing of the blocked perforations, allowing a greater flow of hydrocarbons through the perforated tubing upward through the production tubing string.

There is a general perception that when a well is producing hydrocarbons there should be sufficient flow of fluid through the perforated casing to keep the perforations clear of blockages. This is not the case. At the producing zones, the flow of hydrocarbons through the perforations occurs at a relatively low velocity. The flow of hydrocarbons up the production tubing string essentially speeds up as the hydrocarbons approach the wellhead due to the progressive reduction in the pressure being applied to the hydrocarbons as they approach the surface. Dissolved gas present in the hydrocarbons is also released as the hydrostatic pressure decreases whereby the velocity on the surface is far greater than the velocity of the fluid flow at the producing zone. The efficacy of the method and apparatus of the present invention relies on the surge of fluid flow generated when the flushing tool is activated causing wellbore fluid to be drawn into the chamber. When the flushing tool 40 is activated, drawing the wellbore fluids into the chamber 66, the surge of wellbore fluid flowing into the flushing tool 40 causes a corresponding surge of hydrocarbons through the perforations of the perforated tubing 28. This sudden surge of hydrocarbons through the perforations results in flushing of the blocked perforations.

In the embodiment illustrated in FIGS. 2 and 3, the sealing means 70 is in the form of a sliding sleeve, the operation of which is described in greater detail below. The sealing means could equally take the form of a rotating sleeve provided only that the sealing means is moveable from the first position in which the port is sealed to the second position in which the port is open. The sealing means may be self-opening in response to differential pressure between the sealed chamber and the wellbore fluids as described in greater detail below or the sealing means may be caused to move using a mechanical, electrical or hydraulic motor or solenoid.

The flushing tool 40 is provided with a hollow ported mandrel 74 which has an upper end 76 coaxially mounted within the sliding sleeve 70 and a lower end 78 coaxially mounted within the main body 60. The lower end 78 of the ported mandrel 74 is in fluid communication with the chamber 66. The upper end 76 of the ported mandrel 74 has a plurality of ports 68. When the sliding sleeve 70 is in its first position as shown in FIG. 2, each of the plurality of ports 68 is closed and the chamber 66 is sealed against the ingress of wellbore fluids. When the sliding sleeve 70 is in its second position as shown in FIG. 3, each of the plurality of ports 68 is open to allow wellbore fluids flow to flow through the hollow ported mandrel 74 and into the chamber 66. The ported mandrel 74 has a boss 80 which is in abutting contact with an upper bearing surface 82 of the main body 60 and a lower bearing surface 84 of the sliding sleeve 70. The boss 80 prevents downward movement of the sliding sleeve 70 relative to the main body 60 of the flushing tool 40 at all times.

Whilst it is being run into the production tubing string 14 by the running tool 42, the flushing tool 40 is maintained in its sealed configuration by the actuating means 72. In the embodiment described in detail below, the actuating means is activated by way of application of a jarring force. If desired, the actuating means can be activated using a timer configured to release the sealing means after a pre-set interval of time.

In the embodiment illustrated in FIG. 2, the actuating means 72 takes the form of a set of locking keys 86 that are receivable within a keyway 88 provided in a key support sleeve 90. The key support sleeve 90 is coaxially mounted above the ported mandrel 74 and within a fishing neck 50 at the upper end 46 of the flushing tool 40. A set of actuating shear screws 92 is used to prevent axial movement of the key support sleeve 90 relative to the fishing neck 50 whilst the flushing tool 40 is in its sealed configuration. In this way, the locking keys 86 are held in a position whereby they prevent sliding movement of the sliding sleeve 70 until a sufficient force is applied to shear the actuating shear screws 92 in the manner described below.

When the flushing tool 40 is being run into the production tubing string 14 by the running tool 42, the lower end 52 of the running tool 42 is in abutting contact with an upper bearing surface 94 at the upper end 46 of the flushing tool. In this way, a downward axial or jarring force applied via wireline 44 to the running tool 42 is transferred to the flushing tool 40 across the upper bearing surface 94. The flushing tool 40 is changed from its sealed configuration to its activated configuration by applying sufficient downward axial force to shear the actuating shear screws 92. When this is done, the fishing neck 50 moves axially downwardly relative to the position of the key support sleeve 90, allowing the locking keys 86 to move radially inwardly into the keyway 88.

Prior to shearing of the actuating shear screws 92, the sliding sleeve 70 is locked in its first position and restrained against axial movement by way of an upper bearing surface 96 of the sliding sleeve 70 being in abutting contact with the locking keys 86. When the locking keys 86 are released to enter into the keyway 88 as described above, the sliding sleeve 70 is free to move upwards under the influence of differential pressure into its second position, opening the ports 68 as described above. In this way, the sealing means 70 is deemed to be "self-opening" in that it moves of its own accord from the first position to the second position as soon as the actuation means has been activated to release it to move.

The flushing tool 40 is provided with an upper pressure seal 100 and a lower pressure seal 102 which together define a sealed low pressure cavity 104 in which a pocket of air is held at atmospheric pressure. In the embodiment illustrated in FIG. 2, the upper pressure seal 100 is provided in the form of an O'ring which forms a seal between the upper end 76 of the ported mandrel 74 (at a position above the plurality of ports 68) and the upper end 106 of the sliding sleeve 70. After activation, the sliding sleeve 70 moves upwardly because of the pressure differential between the chamber 104 and the wellbore fluids. The air within the sealed low pressure cavity 104 is compressible, allowing the upward movement of the sliding sleeve 70. As the sliding sleeve 70 moves upward, the plurality of ports 68 are opened up to allow flow of wellbore fluids into the chamber 66.

The chamber 66 can be of variable length depending on the size of perforated tubing required to be flushed. In other words, the wider the perforated tubing, the longer the flushing tool. By way of example, the chamber may be between 2 and 10 feet (600 cm to 3 m) long for a land based well or between 2 and 90 feet (600 cm to 30 m) long for a drill rig based well.

A second embodiment of the present invention is now described with reference to FIGS. 4 to 7 in which like reference numerals refer to like parts. In this embodiment, a plurality of flushing tools 40 are stacked end to end on top of each other to form a flushing assembly 110. The flushing assembly shown in FIG. 4 comprises three flushing tools hereinafter referred to as an upper flushing tool 112, an intermediate flushing tool 114 and a lower flushing tool 116. It is to be clearly understood that any number of flushing tools may equally be used to form the assembly and that each of the flushing tools are independently sealed. The intermediate flushing tool may be one of a plurality of intermediate flushing tools. The length of each of the plurality of flushing tools may vary to suit that width of the perforated tubing which in turn is a function of the width of the producing zone. Thus, each of the plurality of flushing tools may have the same length. Alternatively, each of the plurality of flushing tools may be of different lengths to conform to the depth of a given perforated zone that is to be subjected to a flushing operation. Each flushing tool 40 is run into the well bore 10 or production tubing string 14 in sequence using a suitable running tool. There is no requirement that the flushing tools be mechanically coupled to each other.

Figure 4:
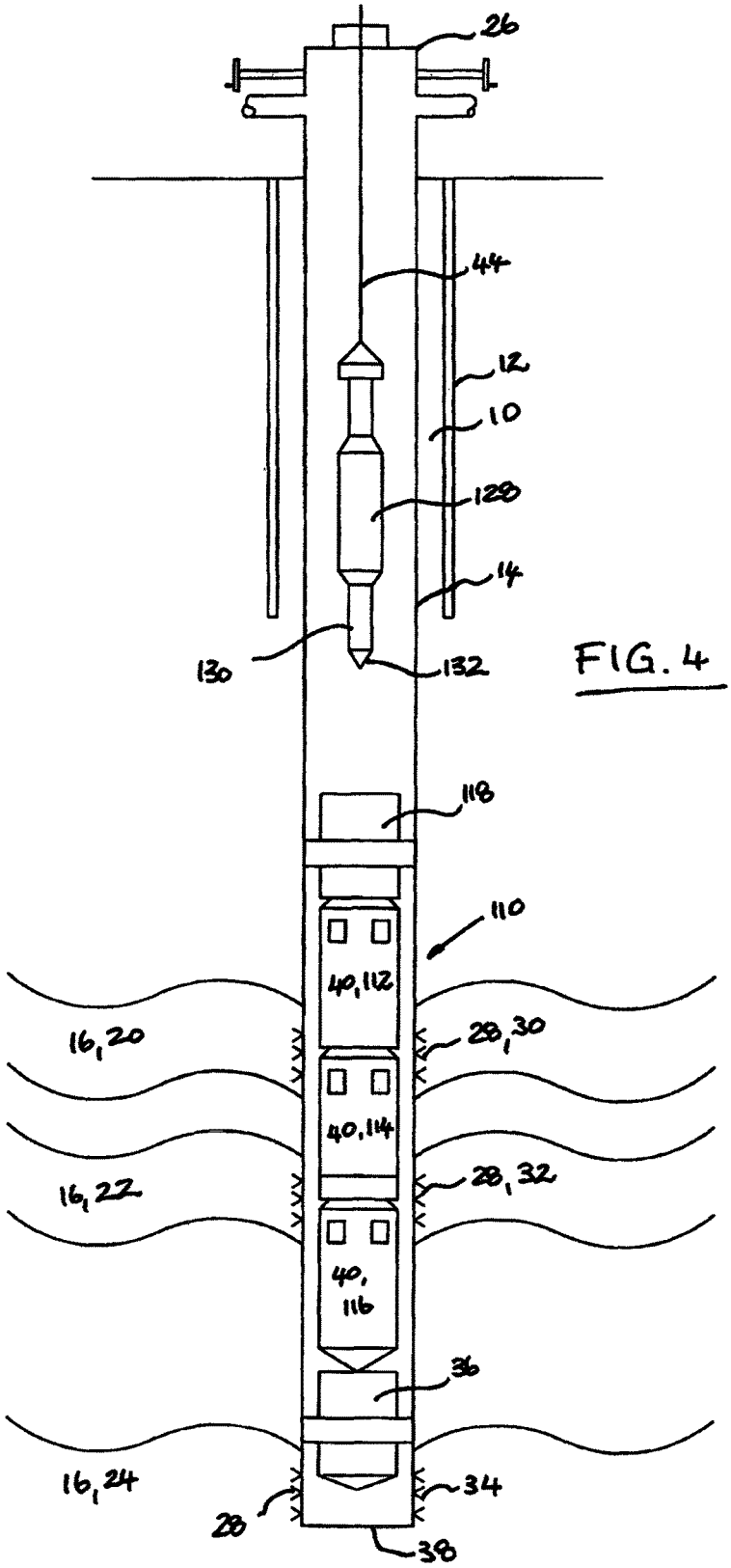
FIG. 4 is a vertical section view taken through a well casing showing the installation of a stack of three flushing tools in the well bore according to a second embodiment of the present invention.

With reference to the embodiment illustrated in FIG. 4, the lower flushing tool 116 is run into the production tubing string 14 and landed on top of the first isolation plug 36. The lower flushing tool 116 is landed adjacent to the intermediate perforated tubing 32 which in turn is located adjacent to the intermediate producing zone 22. Thereafter the intermediate flushing tool 114 is run into the production tubing string 14 and landed on top of the lower flushing tool 116. In this embodiment, the intermediate flushing tool straddles the intermediate perforated tubing 32 and the upper perforated tubing 30. In other words, the intermediate flushing tool straddles the upper producing zone 30 and the intermediate producing zone 22. Thereafter the upper flushing tool 112 is run into the production tubing string 14 and landed on top of the intermediate flushing tool 114. The upper flushing tool 112 is landed adjacent to the upper perforated tubing 30 which in turn is located adjacent to the upper producing zone 20.

In this embodiment, a second isolation packer or plug 118 is positioned in the production tubing string 14 above the upper flushing tool 112. The upper flushing tool 112 may be run into the production tubing string 14 as an independent operation. Alternatively, the upper flushing tool 112 may be mechanically coupled to the second isolation plug 118 such that they are run into the production tubing string 14 as a single operation to save time.

Figure 5:
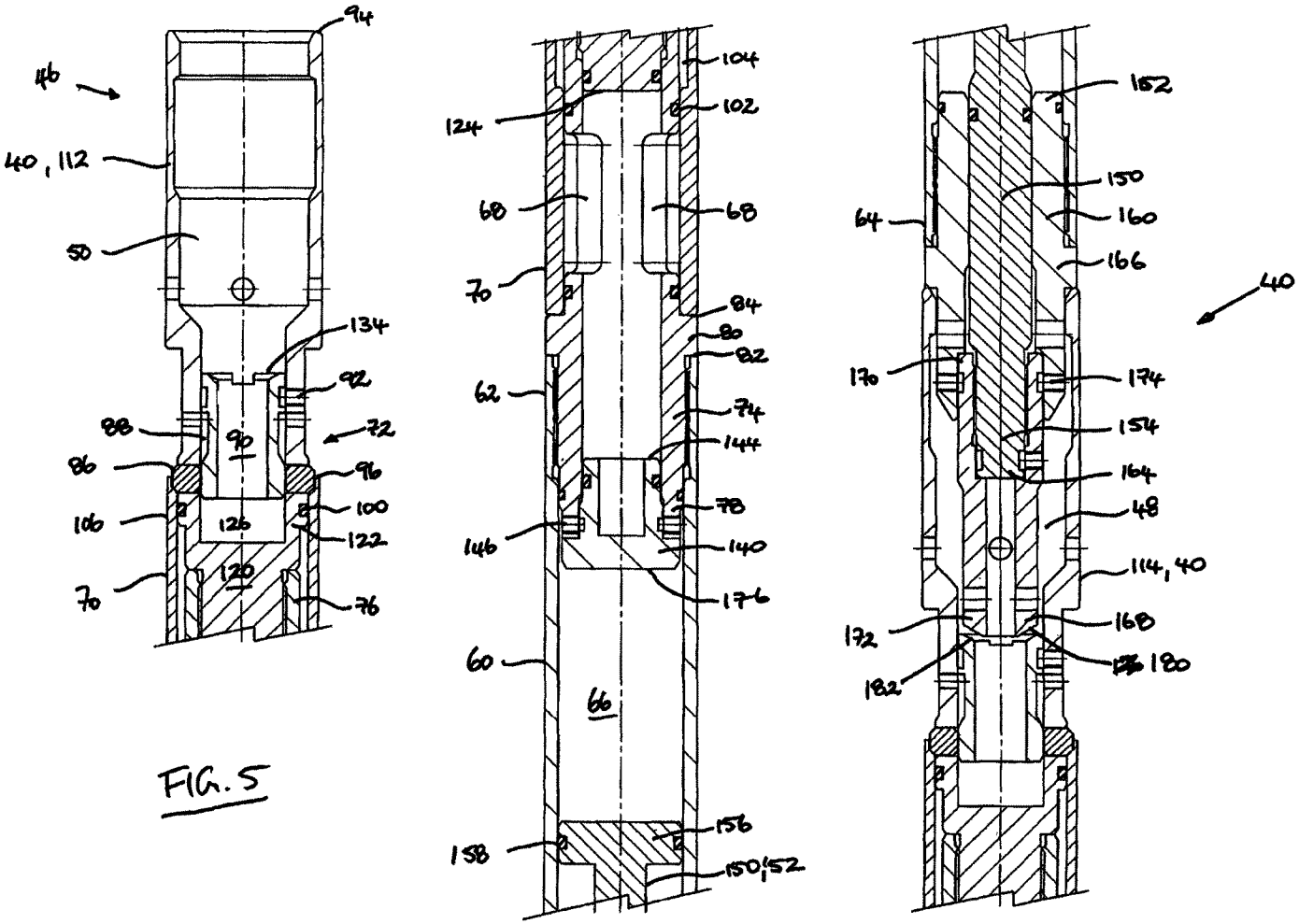
FIG. 5 is a partial cross-section view of the upper and intermediate flushing tools of FIG. 3 split into three portions for the interest of clarity, showing the upper flushing tool in a sealed configuration and the intermediate flushing tool in a sealed configuration.
Figure 6:
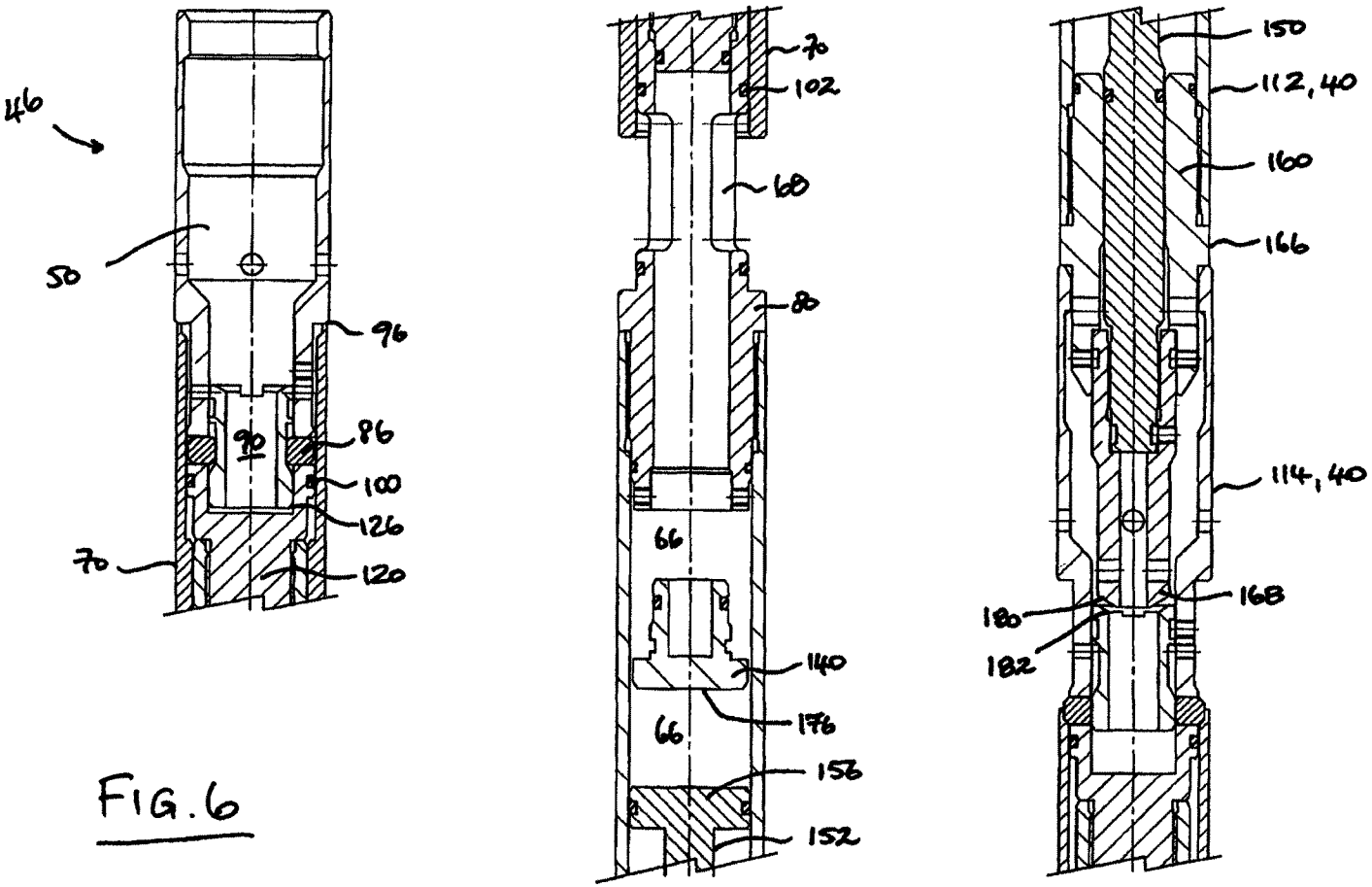
FIG. 6 is a partial cross-section view of the upper and intermediate flushing tools of FIG. 3 split into three portions for the interest of clarity, showing the upper flushing tools in an open configuration with the lower or intermediate flushing tool in a sealed configuration; and, FIG. 7 is a partial cross-section view of the upper and intermediate flushing tools of FIG. 3 split into three portions for the interest of clarity, showing the actuation of the intermediate flushing tool by the upper flushing tool.
Figure 7:
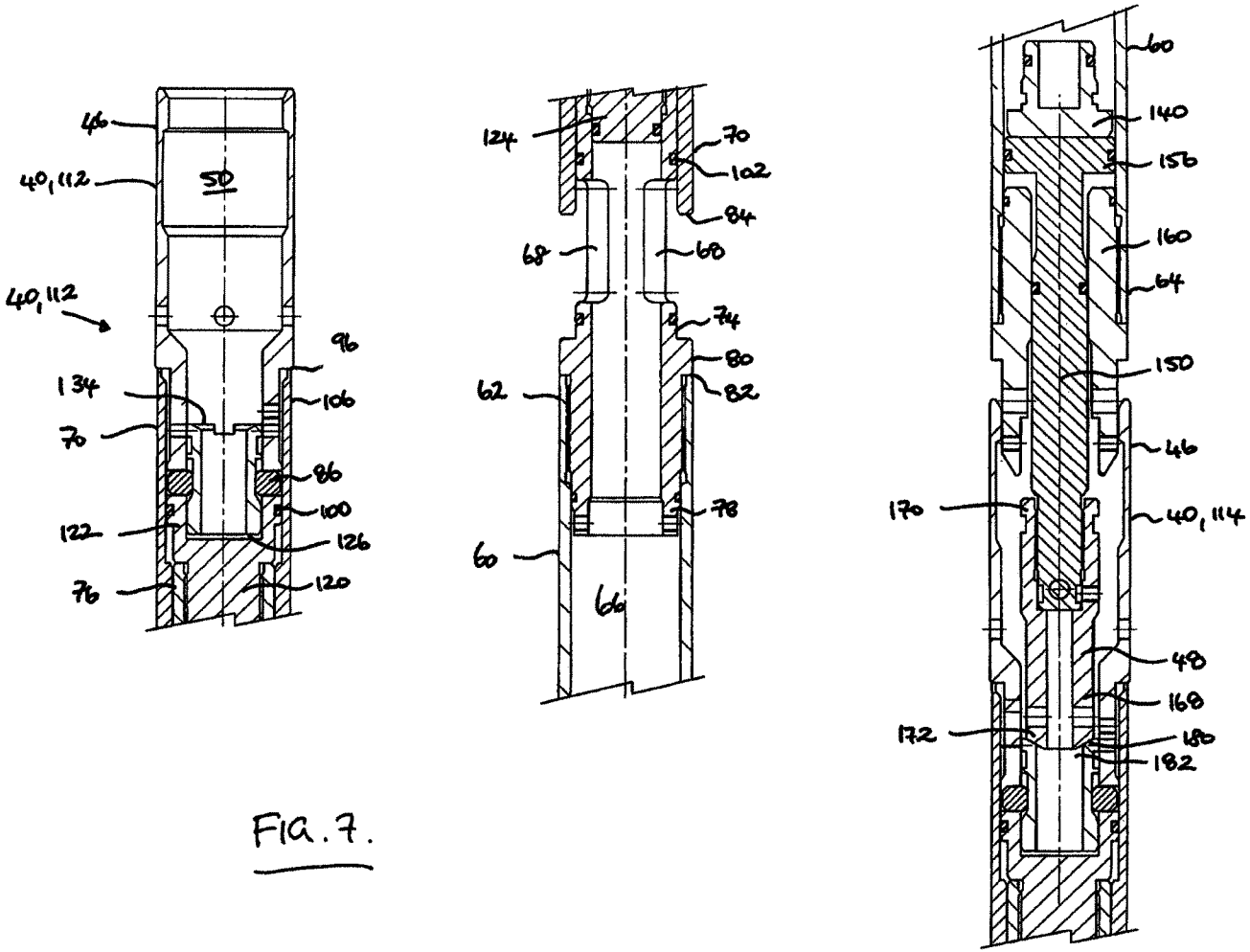

With reference to FIG. 5, each flushing tool 40 is provided with a hollow ported mandrel 74 which has an upper end 76 coaxially mounted within the sliding sleeve 70 and a lower end 78 coaxially mounted within the main body 60. In this embodiment, each flushing tool is further provided with a centralizing spigot 120 having an upper end 122 and a lower end 124. The lower end 124 of the centralizing spigot 120 is received within the upper end of the hollow ported mandrel 74. The upper end 122 of the centralizing spigot 120 is provided with a recess 126 arranged to receive the key support sleeve 90 after shearing of the actuating shear screws 92.

After the flushing tool assembly has been run into the production tubing string, the upper flushing tool 112 is actuated by application of a sufficient downward axial force to shear the actuating shear screws 92 and release the locking keys 86 to move radially into the keyway 88 as described above for the first embodiment. In this second embodiment, a jarring tool 128 is run into the well on wireline 44. The jarring tool 128 has a lower sub 130 which extends through the bore of the second isolation plug 118 and into the fishing neck 50 of the upper flushing tool 112. A lower bearing surface 132 of the lower sub 130 is brought into abutting contact with an upper bearing surface 134 of the key support sleeve 90. In this way, the application of a downward jarring force to the jarring tool 128 via wireline 44 causes shearing of the actuating shear screws 92 which then allows for downward movement of the key support sleeve 90 into the recess 126, allowing the locking keys 86 to move radially inwardly into the keyway 88. When the locking keys 86 are released to enter into the keyway 88 as described above, the sliding sleeve 70 is free to into its second position in the manner described above.

In this second embodiment, each flushing tool is provided with an optional shear out plug 140 located at the lower end 78 of the ported mandrel 74. When the upper flushing tool 112 is actuated, the wellbore fluids pass through the plurality of ports 68 and into a first cavity 142 located within the ported mandrel 74 defined within the lower end 78 of the ported mandrel 74 and terminating at an upper face 144 of the shear out plug 140. The shear out plug 140 is initially restrained from downward movement relative to the lower end 78 of the ported mandrel 74 by a shear out plug release means 146 in the form of a set of shear screws. By way of example, the shear screws used for the shear out plug release means may be rated at 500 psi which is equivalent to the anticipated pressure for the wellbore fluids at a depth of 1000 feet below the well head. When the force exerted by the wellbore fluids on upper face 144 of the shear out plug 140 exceeds the shear rating of the shear screws used for the shear out plug release means 146, the shear out plug 140 is free to move downwardly towards the lower end 64 of the main body 60 through the chamber 66.

The flushing tools of this second embodiment of the present invention are provided with a lower piston 150 having an upper end 152 and a lower end 154. The upper end 152 of the lower piston terminates in a lower piston head 156 which is provided with an upper fluid-tight seal 158. The upper fluid-tight seal 158 and lower piston head 156 work in combination with the lower pressure seal 102 and the lower end 124 of the centralising spigot 120 to maintain the pressure within the chamber 66 at or below atmospheric pressure when the sliding sleeve is in its first position. After actuation of the flushing tool, the upper fluid-tight seal 158 and lower piston head 156 work in combination with the lower pressure seal 102 and the lower end 124 of the centralising spigot 120 to hold the wellbore fluids within the chamber 66.

The lower piston 150 is slidably mounted within a lower piston housing 160. The lower piston housing 160 has an upper end 162, a lower end 164 and a boss 166. The lower end 164 of the lower piston 150 is mechanically coupled with an impact sub 168 in such a way that axial downward movement of the lower piston 150 within the lower piston housing 160 causes down movement of the impact sub 168. The impact sub 168 has an upper end 170 and a lower end 172. The upper end 170 of the impact sub 168 is coaxially mounted in the lower end 164 of the lower piston housing 160. The lower end 172 of the impact sub 168 extends below the lower piston housing 160 and is configured to be received within the fishing neck 50 of the next flushing tool located below a given flushing tool in the assembly.

By way of example, the impact sub 168 of the upper flushing tool 112 is receivable within the fishing neck 50 of the intermediate flushing tool 114. In the same way, the lower end 172 of the impact sub 168 of the intermediate flushing tool 114 is receivable within the fishing neck 50 of the lower flushing tool 116. During stacking of the flushing tools to form the flushing tool assembly 110, the lower end 172 of the impact sub 168 of the upper flushing tool 112 is received within the fishing neck 50 of the intermediate flushing tool 114 and the lower end 172 of the impact sub 168 of the intermediate flushing tool 114 is received within the fishing neck 50 of the lower flushing tool 116. Prior to actuation of the upper flushing tool 112 there is no abutting contact between the respective impact subs 168 and the respective key support sleeves 90.

The use of the flushing tool assembly is now described. After the assembly has been run into the production tubing string, a downward jarring force is applied via wireline to actuate the upper flushing tool 112 by releasing the actuating means 72 to allow the sliding sleeve 70 to move from its first position to its second position. Wellbore fluid rushes into the first and second chamber of the upper flushing tool which encourages flushing of the perforated tubing adjacent to the upper flushing tool. When sufficient pressure is applied to the upper face 144 of the shear out plug 140 to cause shearing of the shear out plug release means 146, the shear out plug 140 moves downwardly through the chamber 66 under the weight of the wellbore fluids. In this way, a lower bearing surface 176 of the shear out plug 140 applies pressure to the lower piston head 156 to cause shearing of the lower piston release screws 174. Thereafter, the lower piston 150 is free to move downwardly within the lower piston housing 160, driving a lower bearing surface 180 of the impact sub 168 into abutting contact with an upper bearing surface 182 of the key support sleeve 90 of the intermediate flushing tool 114. Sufficient force is transferred in this way to cause actuation of the intermediate flushing tool 114 which in turn leads to actuation of the lower flushing tool 116 in succession.

It is to be clearly understood that when the flushing tools are initially run into the production tubing string to form the assembly 110, there is no contact between the lower bearing surface of the impact sub of the upper flushing tool 112 and the upper bearing surface of the key support sleeve 90 of the intermediate flushing tool 114. Similarly, prior to actuation, there is no contact between the lower bearing surface of the impact sub of the intermediate flushing tool 114 and the upper bearing surface of the key support sleeve 90 of the lower flushing tool 116.

When the flushing operation has been completed, the flushing tool(s) are retrieved to the surface using fishing, methods known in the art. If there is any interest in analysing the fluid drawn into the chamber, then it can be closed again before being retrieved to surface.

Numerous variations and modifications will suggest themselves to persons skilled in the relevant art, in addition to those already described, without departing from the basic inventive concepts. If desired, an anti-scaling or anti-fouling agent such as dilute hydrochloric acid is dumped into the annual void between the internal diameter of the perforated tubing and the outer diameter of the flushing tool. Any suitable product that can dissolve or inhibit iron sulphide scale, carbonate scale, metal oxides or other solid deposits found in a hydrocarbon fluid well environment can be used. The anti-scaling or anti-fouling agent can be left to soak prior to flushing operations to allow time for scale that has deposited in the perforations to dissolve. All such variations and modifications are to be considered within the scope of the present invention, the nature of which is to be determined from the foregoing description and the appended claims.

It will be clearly understood that, although prior art use is referred to herein, this reference does not constitute an admission that any of these form a part of the common general knowledge in the art, in Australia or in any other country. In the summary of the invention and the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed:

1. A flushing tool for a perforated tubing in a production tubing string containing wellbore fluids, the flushing tool having a sealed configuration and an activated configuration, the flushing tool comprising:

a chamber that is sealed at a pressure at or below atmospheric pressure when the flushing tool is in its sealed configuration, the chamber arranged to receive wellbore fluids when the flushing tool is in its activated configuration;

a port for allowing ingress of wellbore fluids into the chamber when the flushing tool is in its activated configuration;

a sealing means having a first position when the flushing tool is in its sealed configuration in which the port is sealed against the ingress of wellbore fluids and a second position when the flushing tool is in its activated configuration in which the port is open to allow wellbore fluids to flow into the chamber; and, an actuator for releasing the flushing tool from its sealed configuration to its activated configuration by releasing the sealing means to move from the first position to the second position and thereby open the port, whereby, in use, movement of the sealing means into the second position causes an ingress of wellbore fluids into the chamber whereby the perforated tubing is flushed to improve hydrocarbon flow; and wherein the chamber further comprises a shear out plug retained by a shear out plug release means, whereby in use, the ingress of wellbore fluids causes shearing of the shear out plug release means to allow downward movement of the shear out plug.

2. The flushing tool of claim 1 wherein the sealing means is self-opening upon activation of the actuator.

3. The flushing tool of claim 1 wherein the sealing means moves from the first position to the second position, upon release under the influence of differential pressure applied by the wellbore fluids.

4. The flushing tool of claim 1 wherein the sealing means is a sliding or rotating sleeve.

5. The flushing tool of claim 1 wherein the pressure within the chamber is held at or below atmospheric pressure when the flushing tool is in its sealed configuration.

6. The flushing tool of claim 1 wherein the actuator is activated by way of application of a jarring force.

7. The flushing tool of claim 1 wherein the actuator is activated using a timer configured to release the sealing means after a pre-set interval of time.

8. The flushing tool of claim 1 wherein the actuator comprises a set of locking keys receivable within a keyway provided in a key support sleeve.

9. The flushing tool of claim 8 wherein a set of actuating shear screws prevents axial movement of the key support sleeve whilst the flushing tool is in its sealed configuration until a sufficient force is applied to shear the actuating shear screws.

10. The flushing tool of claim 1 wherein the perforated tubing is located adjacent to at least one producing zone in a hydrocarbon formation, wherein the at least one producing zone is one of a plurality of producing zones within a hydrocarbon-bearing formation.

11. The flushing tool of claim 1 wherein the flushing tool is one of a plurality of flushing tools provided in a stacked arrangement to form a flushing assembly.

12. The flushing tool of claim 11 wherein the chamber of each of the plurality of flushing tools is independently sealed.

13. The flushing tool of claim 11 wherein a flushing tool in the flushing assembly straddles more than one of a plurality of producing zones.

14. The flushing tool of claim 1 wherein the flushing tool includes a lower piston retained by a lower piston release means, whereby in use, downward movement of the shear out plug causes shearing of the lower piston release means to allow downward movement of the lower piston.

15. The flushing tool of claim 14 wherein the flushing tool includes an impact sub arranged at a lower end of the flushing tool, whereby in use, downward movement of the lower piston of an upper flushing tool brings the impact sub of the upper flushing tool into abutting contact with a lower or intermediate flushing tool in a flushing tool assembly with sufficient force to cause actuation of the lower or intermediate flushing tool.

16. The flusing tool according to claim 1, further comprising a connection for connecting the flushing tool to a wireline running tool.

17. A method of flushing a perforated tubing in a production tubing string containing wellbore fluids using a flushing tool having a sealed configuration and an activated configuration, the method comprising the steps of:

a) running the flushing tool in its sealed configuration into the production tubing string using a running tool, the flushing tool having a chamber sealed at a pressure at or below atmospheric pressure when the flushing tool is in its sealed configuration, b) landing the flushing tool in its sealed configuration adjacent to the perforated tubing;

c) thereafter releasing the flushing tool from its sealed configuration to its activated configuration by moving a sealing means from a first position in which a port is sealed against the ingress of wellbore fluids and a second position in which the port is open to allow wellbore fluids to flow into the chamber, whereby the perforated tubing is flushed as wellbore fluids flow into the chamber, and wherein ingress of fluids causes shearing of a shear out plug release means to allow downward movement of a shear out plug.

18. The method of claim 17 wherein the flushing tool is one of a plurality of flushing tools and step a) and step b) are performed for each flushing tool to form a flushing tool assembly having an upper flushing tool and a lower flushing tool in a stacked arrangement.

19. The method of claim 18 wherein releasing the upper flushing tool from its sealed configuration to its activated configuration in step c) causes the lower flushing tool to be released from its sealed configuration to its activated configuration.

20. The method of claim 18 wherein each of the plurality of flushing tools is run into the production tubing string in sequence using a suitable wireline running tool.

21. The method according to claim 17, further comprising running the flushing tool in its sealed configuration into the production tubing string using a wireline running tool.

22. A flushing tool assembly for a perforated tubing in a production tubing string containing wellbore fluids, the flushing tool assembly having a plurality of wireline-deployed flushing tools each having a sealed configuration and an activated configuration, and wherein each flushing tool comprises:

a chamber that is sealed at a pressure at or below atmospheric pressure when the flushing tool is in its sealed configuration, the chamber arranged to receive wellbore fluids when the flushing tool is in its activated configuration;

a port for allowing ingress of wellbore fluids into the chamber when the flushing tool is in its activated configuration;

a sealing means having a first position when the flushing tool is in its sealed configuration in which the port is sealed against the ingress of wellbore fluids and a second position when the flushing tool is in its activated configuration in which the port is open to allow wellbore fluids flow to flow into the chamber; and, an actuator for releasing the flushing tool from its sealed configuration to its activated configuration by releasing the sealing means to move from the first position to the second position and thereby open the port, whereby, in use, movement of the sealing means into the second position causes an ingress of wellbore fluids into the chamber whereby the perforated tubing is flushed to improve hydrocarbon flow; and wherein the assembly comprises a load transfer configuration arranged to transfer a force from actuation of an upper flushing tool, to thereby cause successive actuation of a lower flushing tool.

23. The assembly according to claim 22, wherein the chamber further comprises a shear out plug retained by a shear out plug release means, whereby in use, the ingress of wellbore fluids causes shearing of the shear out plug release means to allow downward movement of the shear out plug.

24. A method of flushing a perforated tubing in a production tubing string containing wellbore fluids using a flushing tool assembly having a plurality of flushing tools, each flushing tool having a sealed configuration and an activated configuration, the method comprising the steps of:

a) running the flushing tool assembly with the flushing tools in their sealed configuration into the production tubing string using a wireline running tool, the flushing tools each having a chamber sealed at a pressure at or below atmospheric pressure when the flushing tool is in its sealed configuration;

b) landing the flushing tool assembly with each flushing tool in its sealed configuration adjacent to the perforated tubing;

c) thereafter releasing each of the flushing tools from its sealed configuration to its activated configuration by moving a sealing means of each of the flushing tools from a first position in which a port in the respective flushing tool is sealed against the ingress of wellbore fluids and a second position in which the port is open to allow wellbore fluids flow to flow into the chamber, whereby the perforated tubing is flushed as wellbore fluids flow into the chamber of the respective flushing tool, wherein actuation of an upper flushing tool transfers a force via a load transfer configuration to cause successive actuation of a lower flushing tool.

25. The method according to claim 24 wherein ingress of wellbore fluids causes shearing of a shear out plug release means to allow downward movement of a shear out plug.

26. A wireline tool assembly comprising a wireline running tool and a flushing tool for a perforated tubing in a production tubing string containing wellbore fluids, the flushing tool having a sealed configuration and an activated configuration, the flushing tool comprising:

a chamber that is sealed at a pressure at or below atmospheric pressure when the flushing tool is in its sealed configuration, the chamber arranged to receive wellbore fluids when the flushing tool is in its activated configuration;

a port for allowing ingress of wellbore fluids into the chamber when the flushing tool is in its activated configuration;

a sealing means having a first position when the flushing tool is in its sealed configuration in which the port is sealed against the ingress of wellbore fluids and a second position when the flushing tool is in its activated configuration in which the port is open to allow wellbore fluids flow to flow into the chamber, wherein the sealing means is a sliding or rotating sleeve; and, an actuator for releasing the flushing tool from its sealed configuration to its activated configuration by releasing the sealing means to move from the first position to the second position and thereby open the port;

wherein the actuator is configured to be activated by way of application of a jarring force; and whereby, in use, movement of the sealing means into the second position causes an ingress of wellbore fluids into the chamber whereby the perforated tubing is flushed to improve hydrocarbon flow.

27. A method of flushing a perforated tubing in a production tubing string containing wellbore fluids using a flushing tool having a sealed configuration and an activated configuration, the method comprising the steps of:

a) running the flushing tool in its sealed configuration into the production tubing string using a wireline running tool, the flushing tool having a chamber sealed at a pressure at or below atmospheric pressure when the flushing tool is in its sealed configuration;

b) landing the flushing tool in its sealed configuration adjacent to the perforated tubing;

c) thereafter actuating an actuator by application of a jarring force to release the flushing tool from its sealed configuration to its activated configuration by moving a sealing means being a sliding or rotating sleeve from a first position in which a port is sealed against the ingress of wellbore fluids to a second position in which the port is open to allow wellbore fluids to flow into the chamber, whereby the perforated tubing is flushed as wellbore fluids flow into the chamber.

* * * * *